US006595150B2

(12) United States Patent
Yamazaki

(10) Patent No.: US 6,595,150 B2
(45) Date of Patent: Jul. 22, 2003

(54) THREAD TENSION CONTROL DEVICE FOR A SEWING MACHINE

(75) Inventor: Tohru Yamazaki, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/206,220

(22) Filed: Jul. 29, 2002

(65) Prior Publication Data

US 2003/0056701 A1 Mar. 27, 2003

(30) Foreign Application Priority Data

Aug. 28, 2001 (JP) ..... 2001-257972

(51) Int. Cl.[7] ..... D05B 19/12; D05B 47/04
(52) U.S. Cl. ..... 112/470.05; 112/254
(58) Field of Search ..... 112/470.05, 470.01, 112/254, 255; 242/150 R

(56) References Cited

U.S. PATENT DOCUMENTS 3,782,313 A * 1/1974 Conti ..... 112/254 X
4,377,980 A * 3/1983 Hanyu et al. ..... 112/254
4,867,082 A * 9/1989 Sabbioni et al. ..... 112/470.04
5,033,400 A * 7/1991 Fischer ..... 112/254
6,089,172 A * 7/2000 Takenoya et al. ..... 112/470.04

FOREIGN PATENT DOCUMENTS

JP 7-52693 12/1995

* cited by examiner

*Primary Examiner*—Peter Nerbun
(74) *Attorney, Agent, or Firm*—Jones, Tullar & Cooper, P.C.

(57) ABSTRACT

A pair of tension discs is disposed on a tension stud fixed in part of a sewing machine main body. A pneumatic cylinder has a drive rod. The drive rod moves at least one of the tension discs to other tension disc so that one tension disc is pressed to other tension disc. An air regulator is interposed between the pneumatic cylinder and an air supply source, being composed in an electropneumatic system for converting between voltage and air pressure. By controlling the applied voltage to the electropneumatic air regulator on the basis of an instruction from a microcomputer, the set pressure of the air supplied to the pneumatic cylinder is adjusted. Thereby the pressure to the thread held between the pair of tension discs, that is, the thread tension is controlled. As a result, without having to stop the operation of the sewing machine, the thread tension can be adjusted promptly and appropriately.

5 Claims, 2 Drawing Sheets

THREAD TENSION CONTROL DEVICE FOR A SEWING MACHINE

BACKGROUND OF THE INVENTION

1. Field of the Invention

The present invention relates to a thread tension control device for a sewing machine, said device is used for providing a stable tension to a thread by regulating the pressure applied to the thread interposed between a pair of tension discs.

2. Description of the Prior Art

As this kind of thread tension control device for a sewing machine, it is proposed, as disclosed in Japanese Utility Model Publication No. 7-52693, to provide an adequate tension to a thread by regulating the tension applied to the thread interposed between a pair of tension discs by using a pneumatic cylinder equipped with an air regulator.

In this thread tension control device proposed hitherto, a pair of tension discs are disposed on a tension stud fixed in part of the sewing machine main body. One tension disc of the pair of tension discs is fixed on the tension stud, and other tension disc is freely fitted on the tension stud slidably in its axial direction. This other slidable tension disc is engaged with a drive rod of the pneumatic cylinder. By moving the other tension disc to the fixed tension disc side through the action of the pneumatic cylinder, the thread engaged with the tension stud and interposed between the pair of tension discs is pressed and held.

Between the pneumatic cylinder and an air supply source, there is an air regulator composed of a variable type constant back pressure valve. When a back pressure regulating knob attached to the air regulator is manipulated, air pressure to be supplied to the pneumatic cylinder is regulated. By regulating this knob, it is designed to adjust the pressure to the thread held between the pair of tension discs, that is, to regulate the thread tension.

However, in the conventional thread tension control device for a sewing machine having such configuration, in order to check if the supply air pressure to the pneumatic cylinder is appropriate or not, the operator has to read the indication value of the pressure gauge connected to the air piping between the air regulator and pneumatic cylinder. As a result, to adjust the thread tension during operation of the sewing machine, the operation of the sewing machine must be stopped once, and its adjustment requires time and labor for manipulating the back pressure regulating knob and reading the indication value of the pressure gauge, and therefore the thread tension could not be adjusted instantly while continuing operation of the sewing machine.

In the case of other conventional thread tension control device combined with a pressure gauge and variable type constant back pressure valve equipped with a back pressure regulating knob, since the data of appropriate air pressure cannot be stored corresponding to the type or size of the thread, such complicated job is required every time the thread is changed.

SUMMARY OF THE INVENTION

The present invention is devised in the light of such background, and it is hence a primary object thereof to present a thread tension control device for a sewing machine capable of adjusting the thread tension instantly while continuing operation of the sewing machine by controlling the air pressure to an adequate value promptly depending on the type or size of the thread.

It is other object of the present invention to eliminate or to save markedly the time and labor every time thread is changed by effectively making use of the data of appropriate air pressure acquired in the past for adjustment of thread tension.

It is a further object of the present invention to release the thread tension instantly in addition to the foregoing objects.

To achieve the primary object, the tension control device for a sewing machine as set forth in claim 1 of the present invention has the following configuration. One end of a tension stud is fixed in part of the sewing machine main body. A pair of tension discs are disposed on the tension stud slidably in its axial direction, and are supported rotatably about the tension stud. A pneumatic cylinder has a drive rod, and the drive rod is engaged with at least one of the pair of tension discs. The drive rod moves one tension disc to other tension disc so that one tension disc is pressed to other tension disc. An air regulator is interposed between the pneumatic cylinder and an air supply source. The pressure to the thread engaged with the tension stud and held between the pair of tension discs is adjusted by the air regulator.

It is a feature of the present invention that the air regulator is composed in an electropneumatic system for converting between voltage and air pressure. As a result, the applied voltage to the electropneumatic air regulator is controlled on the basis of an instruction from a microcomputer, so that the set pressure of the air supplied to the pneumatic cylinder is adjusted.

According to the present invention as set forth in claim 1, since the electropneumatic air regulator is used as the air regulator, the applied voltage to the electropneumatic air regulator can be controlled on the basis of an instruction from the microcomputer. As a result, without spending any time in manipulation of the back pressure regulating knob or reading of pressure gauge, the set pressure of the air to be supplied to the pneumatic cylinder can be adjusted quickly and adequately. Therefore, without having to stop the operation of the sewing machine in thread tension adjustment, the thread tension can be adjusted instantly while continuing this operation.

In particular, as set forth in claim 2, using a pneumatic cylinder of dual action type, by connecting a solenoid valve to the air outlet side port of pneumatic cylinder and opening this solenoid valve on the basis of an instruction from the microcomputer, the pressure to the thread held between the pair of tension discs can be set free so that the thread can be released. Therefore, thread releasing action after specified sewing, and thread tension adjustment by controlling the air set pressure when resuming sewing operation can be done instantly.

Further, as set forth in claim 3, by storing data of control voltage to the electropneumatic air regulator in the microcomputer, and comprising memory means for reading out the data, when using the thread of the same type and size as the thread used in the past, the data of the appropriate air pressure acquired in the past adjustment can be effectively utilized. Therefore, it is possible to eliminate or to save markedly the time and labor for knob manipulation for adjusting the air pressure appropriately every time the thread is changed.

Moreover, as set forth in claims 4 and 5, when a pair of tension discs, the pneumatic cylinder and the electropneumatic air regulator are arranged in plural sets corresponding to a plurality of threads, the pressure to each thread by these plural sets of pair of tension discs can be controlled in batch by the action of the air regulator on the basis of an instruction from the microcomputer. Therefore, without requiring the complicated and labored operation for manipulating the back pressure regulating knob for every one of the plurality of threads, the tension adjustment for the plurality of threads can be controlled in batch by the microcomputer, and the applicability to the sewing machine using a plurality of threads simultaneously may be enhanced.

PREFERRED EMBODIMENT OF THE INVENTION

A preferred embodiment of the present invention is described below while referring to the accompanying drawings.

Figure 1:
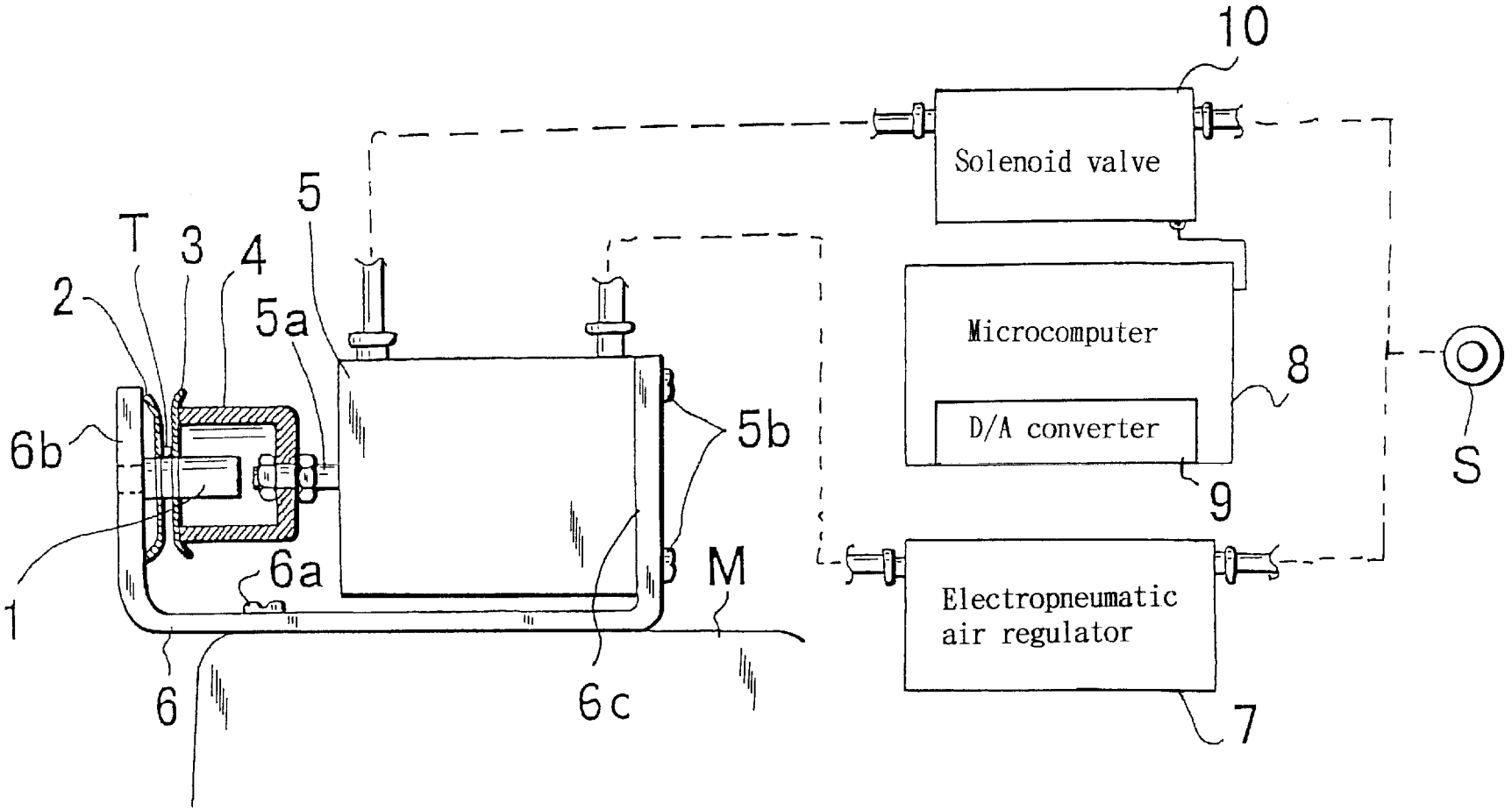
FIG. 1 is a schematic structural diagram showing a thread tension control device for a sewing machine according to the present invention.

FIG. 1 is a schematic structural diagram showing a thread tension control device for a sewing machine according to the present invention. In one arm 6*b* of a U-shaped bracket 6 mounted on a sewing machine main body M with a screw 6*a,* a tension stud 1 is fixed almost horizontally. In other arm 6*c* of the bracket 6, a pneumatic cylinder 5 of dual action type is fixed with screws 5*b,* and a drive rod 5*a* of the pneumatic cylinder 5 is disposed on an extension of the axial line of the tension stud 1.

On the tension stud 1, a pair of tension discs 2, 3 are disposed slidably in the axial direction of the tension stud 1. The pair of tension discs 2, 3 are supported rotatably about the tension stud 1. A presser piece 4 to be engaged with one tension disc 3 is disposed in the drive rod 5*a* of said pneumatic cylinder 5. As the drive rod 5*a* of the pneumatic cylinder 5 advances, the presser piece 4 is engaged with one tension disc 3, so that the pair of tension discs 2, 3 are moved by force to the arm 6*b* side of the bracket 6.

An air regulator 7 is interposed between the pneumatic cylinder 5 and an air supply source S such as compressor. The air regulator 7 is composed in an electropneumatic system for converting between voltage and air pressure, and the applied (input) voltage value and the output air pressure value are characterized to be converted in a linear relation. The electropneumatic air regulator 7 is designed to adjust variably the set pressure of the air supplied to the pneumatic cylinder 5 on the basis of an instruction from a microcomputer 8.

A D/A converter 9 is attached to the microcomputer 8. The D/A converter 9 converts the digital command from the microcomputer 8 into an analog control voltage (set voltage), and the converted analog control voltage is applied to the electropneumatic air regulator 7. When an air pressure depending on the applied voltage value is supplied to the pneumatic cylinder 5, the drive rod 5*a* advances, and the pressure is provided to the thread T between the pair of tension discs 23.

A solenoid valve 10 is connected to one port (air outlet side) of said pneumatic cylinder 5. The solenoid valve 10 is to supply air into the pneumatic cylinder 5 on the basis of an instruction from the microcomputer 8. The gauge pressure of the air from the solenoid valve 10 is set higher than the gauge pressure of the air delivered from the air regulator 7. When the solenoid valve 10 is operated, the drive rod 5*a* moves backward, so that the pressure to the thread T held between the pair of tension discs 2, 3 is set free, and the thread tension is released.

Figure 2:
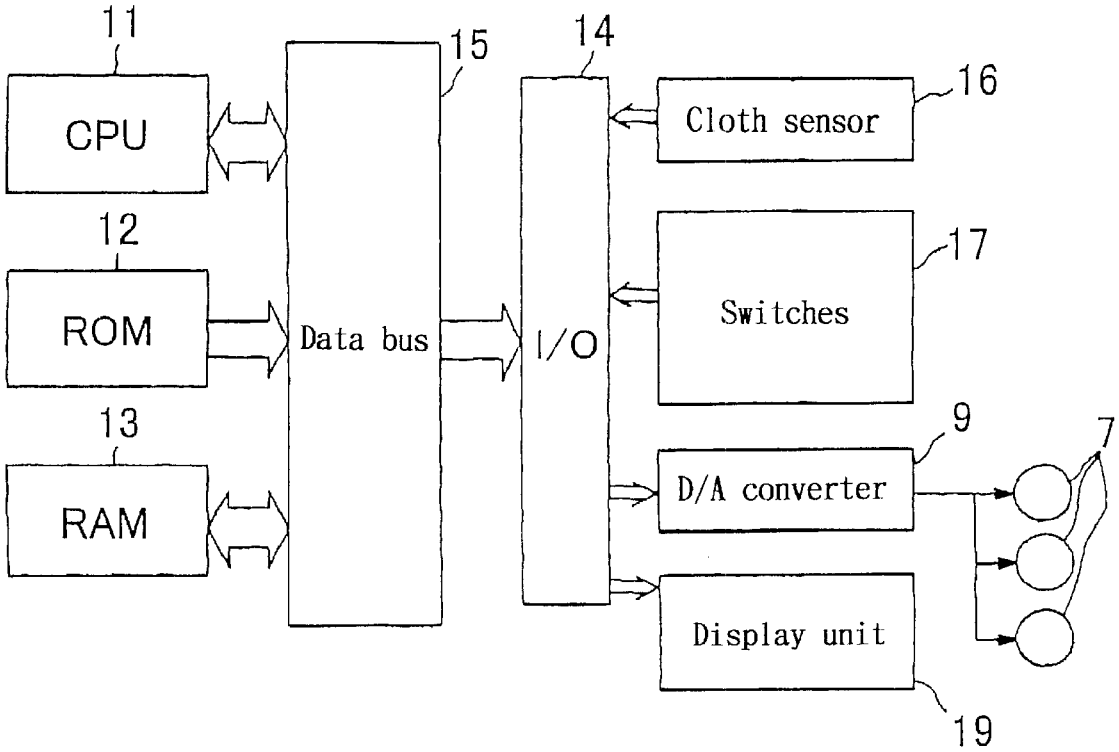
FIG. 2 is a block diagram showing the control system of said thread tension control device.

FIG. 2 is a block diagram showing the control system of the thread tension control device. The microcomputer 8 comprises CPU 11, ROM 12, RAM 13, interface 14, and data bus 15. Specifically, the RAM 13 stores the data of the control voltage (preset voltage) applied to the electropneumatic air regulator 7, and the data can be read out whenever desired through the data bus 15, interface 14, and D/A converter 9. In the interface 14 of the microcomputer 8, cloth sensor 16, switches 17, and display unit 19 are connected. The cloth sensor 16 is disposed near the sewing portion (not shown) of the sewing machine, and issues a signal distinguishing presence or absence of cloth in the sewing portion. The electropneumatic air regulator 7 has a regulator drive circuit (not shown), and is connected to the D/A converter 9.

In the thread tension control device for the sewing machine having such configuration, on the basis of an instruction from the microcomputer 8 by manipulation of switches 17, the applied voltage to the electropneumatic air regulator 7 is controlled by way of the interface 14, D/A converter 9, and regulator drive circuit (not shown). Therefore, the set pressure of the air to be supplied to the pneumatic cylinder 5 is adjusted promptly, and the pressure to the thread held between the pair of tension discs 2, 3 is adjusted. That is, the tension of the thread T can be adjusted instantly.

Herein, in the case of a sewing machine using a plurality of threads simultaneously, the pair of tension discs 2, 3, the pneumatic cylinder 5 and the electropneumatic air regulator 7 are provided in plural sets corresponding to said threads, and the pressure to each thread by these plural sets (2,3,5,7) may be designed to be adjusted in batch on the basis of an instruction from the microcomputer 8. As a result, each thread tension corresponding to the plurality of threads can be adjusted instantly and respectively.

When the thread tension data being once set, that is, the data of the control voltage applied to the electropneumatic air regulator 7 is stored in the RAM 13, in the case of use of the thread of the same type and size, the data of the appropriate air pressure acquired in the past adjustment and stored in the RAM 13 can be read out and used. Hence, the use of this data brings about the elimination or the marked save of the time and labor for adjusting the air pressure appropriately every time the thread is changed.

In the foregoing embodiment, the pair of tension discs are both disposed on the tension stud slidably in its axial direction, but it is not limited. For example, one tension disc may be fixed on the tension stud, and only the other tension disc may be set slidably in the axial direction, so that the other tension disc may be moved to the one tension disc by force when the drive rod of the pneumatic cylinder advances.

The entire disclosure of Japanese Patent Application No. 2001-257972 filed on Aug. 28, 2001, including the specification, claims, drawings and summary are incorporated herein by reference in this entirety.

What is claimed is:

1. A thread tension control device for a sewing machine comprising a tension stud of which one end is fixed in part of a sewing machine main body, a pair of tension discs disposed on the tension stud slidably in its axial line, said tension discs being supported rotatably about the tension stud, a pneumatic cylinder engaged with at least one of the pair of tension discs, said pneumatic cylinder having a drive rod for moving one tension disc to other tension disc side by force, and an air regulator interposed between the pneumatic cylinder and an air supply source, thereby adjusting the pressure to the thread engaged with the tension stud and held between the pair of tension discs, wherein said air regulator is composed in an electropneumatic system for converting between voltage and air pressure, and the applied voltage to the electropneumatic air regulator is controlled on the basis of an instruction from a microcomputer, so that the set pressure of the air supplied to the pneumatic cylinder is adjusted.

2. The thread tension control device for the sewing machine as defined in claim 1, wherein said pneumatic cylinder is of dual action type, and a solenoid valve is connected at an air outlet side port of the pneumatic cylinder, and by operating the solenoid valve on the basis of an instruction from the microcomputer, the pressure to the thread held between the pair of tension discs can be set free so that the thread tension can be released.

3. The thread tension control device for the sewing machine as defined in claim 1, wherein said microcomputer comprises memory means for storing the data of control voltage to the electropneumatic air regulator and reading out the data.

4. The thread tension control device for the sewing machine as defined in claim 1, wherein said tension discs, said pneumatic cylinder and said electropneumatic air regulator are arranged in plural sets corresponding to a plurality of threads, and the pressure to each thread by these plural sets is controlled in batch on the basis of an instruction from the microcomputer.

5. The thread tension control device for the sewing machine as defined in claim 3, wherein said tension discs, said pneumatic cylinder and said electropneumatic air regulator are arranged in plural sets corresponding to a plurality of threads, and the pressure to each thread by these plural sets is controlled in batch on the basis of an instruction from the microcomputer.

* * * * *